US008039770B2

(12) United States Patent
Schaltenbrand et al.

(10) Patent No.: US 8,039,770 B2
(45) Date of Patent: Oct. 18, 2011

(54) MOVABLE CONTACT ARM AND CROSSBAR ASSEMBLY AND ELECTRICAL SWITCHING APPARATUS EMPLOYING THE SAME

(75) Inventors: Brian J. Schaltenbrand, Pittsburgh, PA (US); Mark A. Janusek, Pittsburgh, PA (US); Craig J. Puhalla, Moon Township, PA (US); Louis F. Grahor, Allison Park, PA (US)

(73) Assignee: Eaton Corporation, Cleveland, OH (US)

( * ) Notice: Subject to any disclaimer, the term of this patent is extended or adjusted under 35 U.S.C. 154(b) by 441 days.

(21) Appl. No.: 12/185,969

(22) Filed: Aug. 5, 2008

(65) Prior Publication Data

US 2010/0032269 A1 Feb. 11, 2010

(51) Int. Cl.
*H01H 5/00* (2006.01)

(52) U.S. Cl. ..... 200/400; 200/401

(58) Field of Classification Search ..... 200/401
See application file for complete search history.

(56) References Cited

U.S. PATENT DOCUMENTS 4,472,701 A * 9/1984 Bellows et al. ..... 335/23
5,023,416 A * 6/1991 Oyama et al. ..... 200/244
5,539,167 A 7/1996 Hood et al.
5,994,988 A 11/1999 Ferree et al.

* cited by examiner

*Primary Examiner* — Elvin G Enad
*Assistant Examiner* — Lisa Klaus
(74) *Attorney, Agent, or Firm* — Martin J. Moran

(57) ABSTRACT

A movable arm assembly is for an electrical switching apparatus including a stationary contact and an operating mechanism. The arm assembly includes a biasing member and an arm member having a first end, an opposite second end, a pivot point therebetween, and a portion having a longitudinal axis. A movable contact is disposed at or about the first end. The arm member engages a crossbar member at or about the pivot point such that the arm member can pivot from a first position to a second position. The biasing member engages the arm member at a point between the pivot point and the second end and includes a portion that engages and biases against a housings of the crossbar member. The longitudinal axis of the portion of the arm member is oriented generally parallel to the portion of the biasing member when the arm member is at the first position.

3 Claims, 5 Drawing Sheets

MOVABLE CONTACT ARM AND CROSSBAR ASSEMBLY AND ELECTRICAL SWITCHING APPARATUS EMPLOYING THE SAME

BACKGROUND OF THE INVENTION

1. Field of the Invention

The invention relates generally to circuit interrupters and, more particularly, to contact arm assemblies for electrical switching apparatus, such as circuit breakers. The invention also relates to crossbar assemblies having a movable contact arm assembly. The invention further relates to electrical switching apparatus having a crossbar assembly and a movable contact arm assembly.

2. Background Information

Electrical switching apparatus, such as circuit breakers, provide protection for electrical systems from electrical fault conditions such as, for example, current overloads, short circuits, and other fault conditions. Typically, circuit breakers include a spring powered operating mechanism which opens electrical contacts to interrupt the current through the conductors of an electrical system in response to abnormal conditions.

The electrical contacts generally comprise one or more movable contacts and one or more corresponding stationary contacts. Each pair of separable contacts is electrically connected, in series, between corresponding line and load terminals which are typically positioned at opposite ends of the circuit breaker. More specifically, each movable contact is disposed at or about a first end of a corresponding movable contact arm, which is part of a movable contact assembly. The movable contact arm is pivotably coupled, at or about its second end, to a crossbar of the operating mechanism. A suitable shunt (e.g., without limitation, flexible conductor) electrically connects the movable contact assembly to a load conductor, for example, by way of a clinch joint. The operating mechanism controls the movable contact arm to pivot the movable contact into and out of electrical contact with the corresponding stationary contact. The crossbar carries the movable contact arms for all of the poles of the circuit breaker, and allows for simultaneous opening and closing of the contacts in all of the poles.

Contact pressure between the stationary and movable contacts is typically achieved through the use of compression springs which can commonly attract or be damaged by heat and molten debris produced when each pair of separable contacts is separated and a resulting arc is formed.

As such, there exists a need for improved movable contact arm assemblies and crossbar assemblies for use in electrical switching apparatus.

SUMMARY OF THE INVENTION

These needs and others are met by embodiments of the invention, which are directed to movable arm assembly for an electrical switching apparatus, a crossbar assembly for an operating mechanism of an electrical switching apparatus, and an electrical switching apparatus having a crossbar assembly.

In accordance with one aspect of the invention, a movable arm assembly for an electrical switching apparatus is provided. The electrical switching apparatus includes an enclosure, a stationary contact, and an operating mechanism including a crossbar member having a number of housings. The movable arm assembly comprises: an arm member having a first end, an opposite second end, a pivot point therebetween, and a portion extending generally from the pivot point to the opposite second end, the portion having a longitudinal axis, the arm member being structured to engage the crossbar member at or about the pivot point such that the arm member can pivot with respect to the crossbar member from a first position to a different second position; a movable contact disposed at or about the first end of the arm member, the movable contact being structured to electrically contact the stationary contact when the arm member is at the first position; and a biasing member comprising a first portion and a second portion, the first portion and the second portion being of generally linear shape and oriented generally normal to each other, the first portion of the biasing member engaging the arm member at a point between the pivot point and the second end, and the second portion of the biasing member being structured to engage and bias against one of the number of housings of the crossbar member, wherein the longitudinal axis of the portion of the arm member is oriented generally parallel to the second portion of the biasing member when the arm member is at the first position.

The arm member may further have a notch disposed between the pivot point and the second end, wherein the first portion of the biasing member is disposed within, and engages the notch.

Each of the number of housings of the crossbar member may comprise a first aperture and a second aperture and the arm member may comprise: an aperture disposed at or about the pivot point of the arm member, and a pin member having a first end, an opposite second end, and an intermediate portion therebetween, the intermediate portion disposed in the aperture of the arm member, the first end and the opposite second end of the pin member being structured to be disposed in the first aperture and the second aperture of a corresponding one of the number of housings of the crossbar such that the arm member can pivot with respect to the crossbar member.

The biasing member may comprise a torsion spring having a first leg, a second leg, and a lateral section; wherein the first portion of the biasing member includes the lateral section and the second portion of the biasing member includes the first leg and the second leg. The second portion of the biasing member may be structured to engage the housing generally along the entirety of the second portion.

As another aspect of the invention, a crossbar assembly for an operating mechanism of an electrical switching apparatus is provided. The electrical switching apparatus includes an enclosure and a number of stationary contacts. The crossbar assembly comprises: a crossbar member having a number of housings; and a number of movable arm assemblies, each of the number of movable arm assemblies being disposed in a corresponding one of the number of housings of the crossbar member, each of the number of movable arm assemblies comprising: an arm member having a first end, an opposite second end, a pivot point therebetween, and a portion extending generally from the pivot point to the opposite second end, the portion having a longitudinal axis, the arm member being structured to engage the crossbar member at or about the pivot point such that the arm member can pivot with respect to the crossbar member from a first position to a different second position; a movable contact disposed at or about the first end of the arm member, the movable contact being structured to electrically contact the stationary contact when the arm member is at the first position; and a biasing member comprising a first portion and a second portion, the first portion and the second portion being of generally linear shape and oriented generally normal to each other, the first portion of the biasing member engaging the arm member at a point between the pivot point and the second end, and the second portion of the biasing member being structured to engage and bias against one of the number of housings of the crossbar member, wherein the longitudinal axis of the portion of the arm member is oriented generally parallel to the second portion of the biasing member when the arm member is at the first position.

Each of the number of housings of the crossbar member may comprise a cavity delimited by a first side wall having a first aperture therein, an opposing second side wall having a second aperture therein, a front wall, and a top wall.

The arm member of each of the number of movable arm assemblies may comprise a notch disposed between the pivot point and the second end and the first portion of the biasing member may be disposed within, and engage the notch.

Each of the number of housings of the crossbar member may comprise a first aperture and a second aperture and the arm member may comprise: an aperture disposed at or about the pivot point of the arm member; and a pin member having a first end, an opposite second end, and an intermediate portion therebetween, the intermediate portion disposed in the aperture of the arm member, the first end and the opposite second end of the pin member being disposed in the first aperture and the second aperture of a corresponding one of the number of housings of the crossbar such that the arm member can pivot with respect to the crossbar member.

The biasing member may comprise a torsion spring having a first leg, a second leg, and a lateral section; and the first portion of the biasing member may include the lateral section, and the second portion of the biasing member may include the first leg and the second leg. The second portion of the biasing member may engage the housing generally along the entirety of the second portion.

The front wall of each housing of the number of housings may comprise an aperture through which the arm member of a corresponding one of the number of movable arm assemblies passes therethrough.

The front wall of each of the number of housings may be structured to shield the torsion spring from an arc produced from separation of the movable contact and a corresponding one of the number of stationary contacts.

As a further aspect of the invention, an electrical switching apparatus comprises an enclosure; a number of stationary contacts; and a crossbar assembly. The crossbar assembly comprises: a crossbar member having a number of housings; and a number of movable arm assemblies, each of the number of movable arm assemblies being disposed in a corresponding one of the number of housings of the crossbar member, each of the number of movable arm assemblies comprising: an arm member having a first end, an opposite second end, a pivot point therebetween, and a portion extending generally from the pivot point to the opposite second end, the portion having a longitudinal axis, the arm member being structured to engage the crossbar member at or about the pivot point such that the arm member can pivot with respect to the crossbar member from a first position to a different second position; a movable contact disposed at or about the first end of the arm member, the movable contact being structured to electrically contact the stationary contact when the arm member is at the first position; and a biasing member comprising a first portion and a second portion, the first portion and the second portion being of generally linear shape and oriented generally normal to each other, the first portion of the biasing member engaging the arm member at a point between the pivot point and the second end, and the second portion of the biasing member being structured to engage and bias against one of the number of housings of the crossbar member, wherein the longitudinal axis of the portion of the arm member is oriented generally parallel to the second portion of the biasing member when the arm member is at the first position.

Each of the number of housings of the crossbar member may comprise a cavity delimited by a first side wall having a first aperture therein, an opposing second side wall having a second aperture therein, a front wall, and a top wall.

The arm member of each of the number of movable arm assemblies may comprise a notch disposed between the pivot point and the second end and the first portion of the biasing member may be disposed within, and engage the notch.

Each of the number of housings of the crossbar member may comprise a first aperture and a second aperture; and the arm member may comprise: an aperture disposed at or about the pivot point of the arm member; and a pin member having a first end, an opposite second end, and an intermediate portion therebetween, the intermediate portion being disposed in the aperture of the arm member, the first end and the opposite second end of the pin member being disposed in the first aperture and the second aperture of a corresponding one of the number of housings of the crossbar such that the arm member can pivot with respect to the crossbar member.

The biasing member may comprise a torsion spring having a first leg, a second leg, and a lateral section; and the first portion of the biasing member may include the lateral section, and the second portion of the biasing member may include the first leg and the second leg. The second portion of the biasing member may engage the housing generally along the entirety of the second portion of the biasing member.

The front wall of each housing of the number of housings may comprise an aperture through which the arm member of a corresponding one of the number of movable arm assemblies passes therethrough.

The front wall of each of the number of housings may be structured to shield the torsion spring from an arc produced from separation of the movable contact and a corresponding one of the number of stationary contacts.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
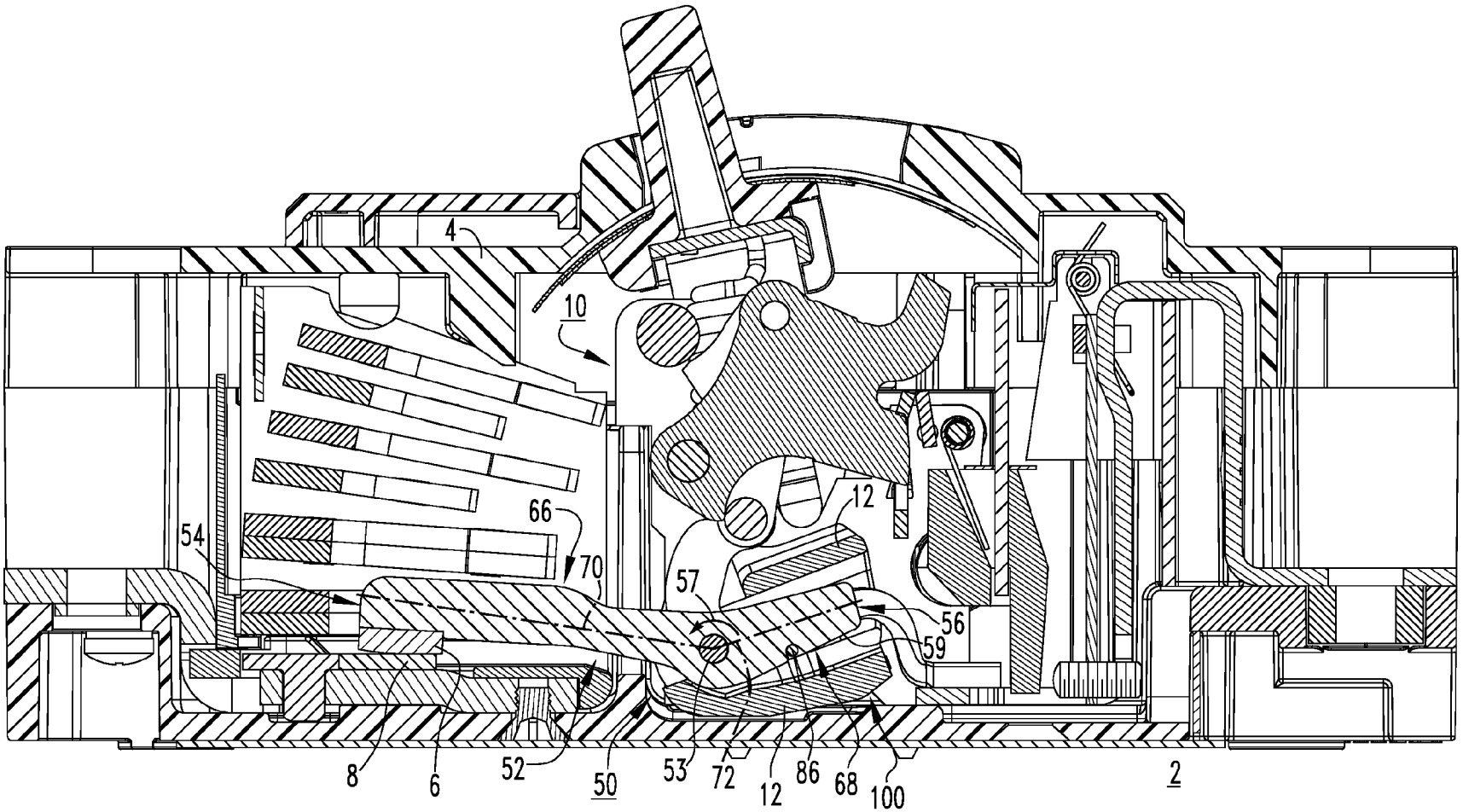
FIG. 1 is a vertical elevation sectional view of a circuit breaker including a movable contact assembly in accordance with an embodiment of the invention.

Directional phrases used herein, such as, for example, left, right, front, back, clockwise, counterclockwise and derivatives thereof, relate to the orientation of the elements shown in the drawings and are not limiting upon the claims unless expressly recited therein.

As employed herein, the statement that two or more parts are "coupled" together shall mean that the parts are joined together either directly or joined through one or more intermediate parts.

As employed herein, the term "number" shall mean one or an integer greater than one (i.e., a plurality).

As employed herein, the term "generally normal" shall mean that two elements are oriented at or about 90 degrees with respect to each other.

As employed herein, the term "generally parallel" shall mean that two elements are oriented at or about 0 degrees relative to each other.

FIG. 1 shows a circuit breaker 2 having a movable contact assembly 50. The circuit breaker 2 generally includes an enclosure 4, separable contacts 6, 8 housed by the enclosure 4, and an operating mechanism 10. The operating mechanism 10 includes at least one movable contact assembly 50. For simplicity of illustration, one movable contact assembly 50, and one pair of separable contacts 6, 8 therefor, will be shown and described herein. It will, however, be appreciated that any known or suitable number of movable contact assemblies 50 could be employed. For example, typically for a multi-pole molded case circuit breaker 2 such as the one shown in FIG. 1, one movable contact assembly 50 is employed for each pole of the circuit breaker 2.

Figure 2:
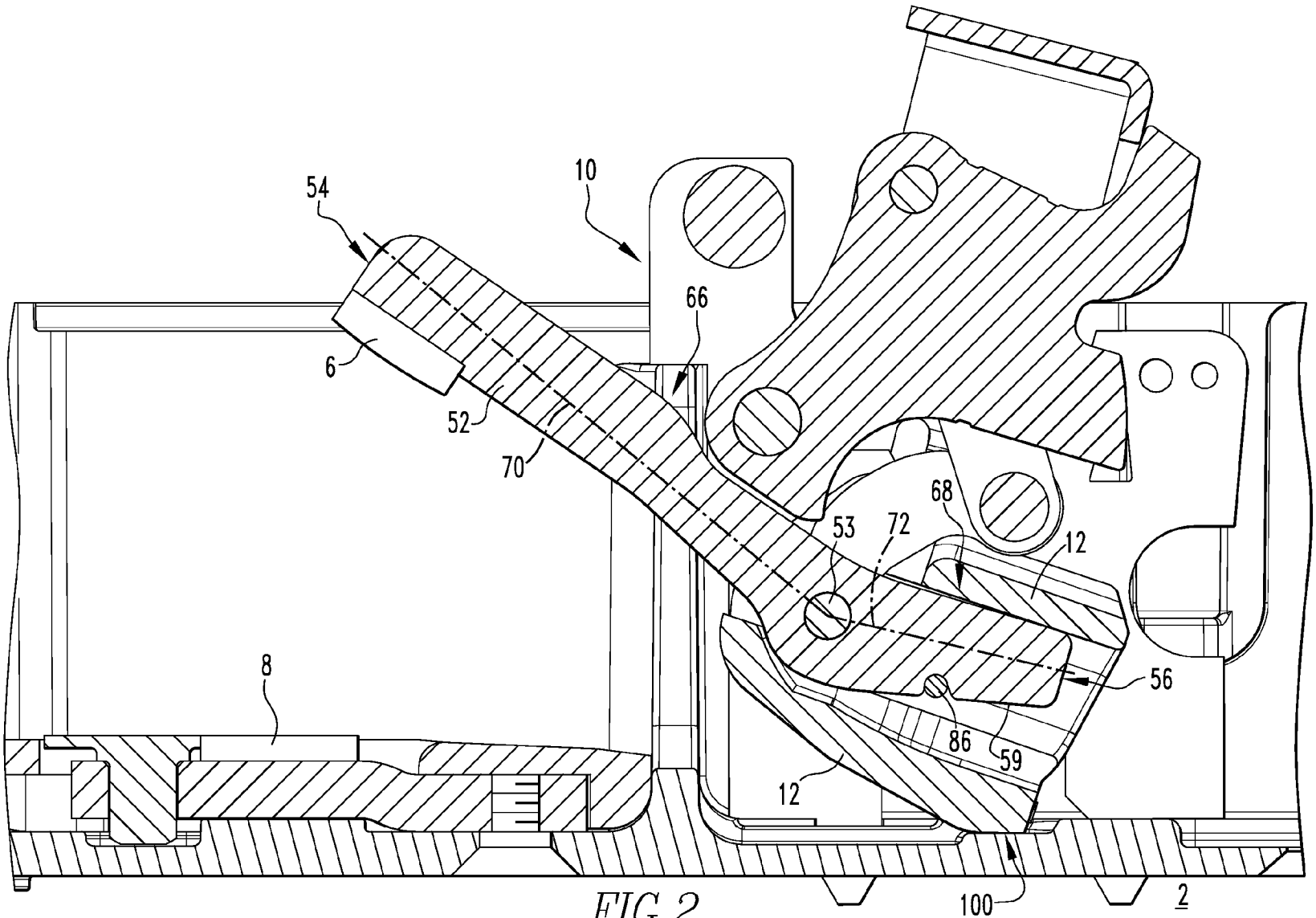
FIG. 2 is a view of a portion of the circuit breaker of FIG. 1 in an alternate position.

Continuing to refer to FIG. 1, and also to FIG. 2, it will be appreciated that the separable contacts comprise a movable contact 6, and a stationary contact 8. As shown in FIG. 1, the operating mechanism 10 includes a crossbar 12 having a housing 100. The operating mechanism 10 and crossbar 12 are structured to move the moveable contact 6 into and out of electrical contact with the stationary contact 8. The movable contact assembly 50 includes a movable contact arm 52 having a first end 54 and an opposite second end 56 housed with the housing 100. The movable contact 6 is disposed at or about the first end 54 of the movable contact arm 52, as shown. The movable contact arm 52 is pivotably coupled to the crossbar 12 of operating mechanism 10 by a pivot pin 53 that passes through an aperture 55 (FIG. 3) of the movable contact arm 52. As shown in the Figures, movable contact arm 52 generally comprises two portions of generally linear shape 66,68, with the first generally linear portion 66 extending generally between the first end 54 and the aperture 55 and having a first longitudinal axis 70, and the second generally linear portion 68 extending between the second end 56 and the aperture 53 and having a second longitudinal axis 72.

Figure 3:
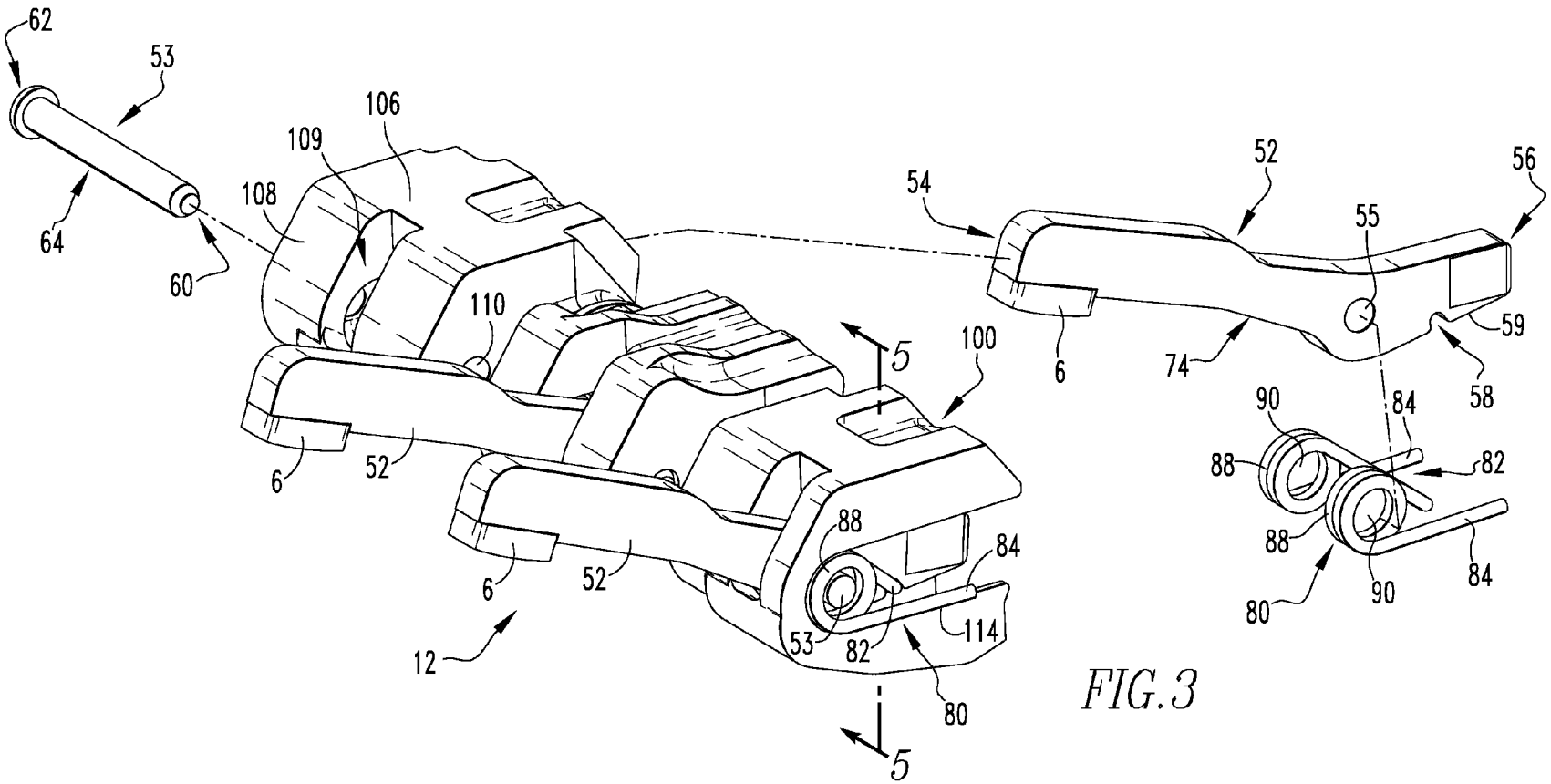
FIG. 3 is a partially exploded isometric view of a crossbar assembly in accordance with another embodiment of the invention, with a portion of one crossbar housing cut away to show internal structure.
Figure 4:
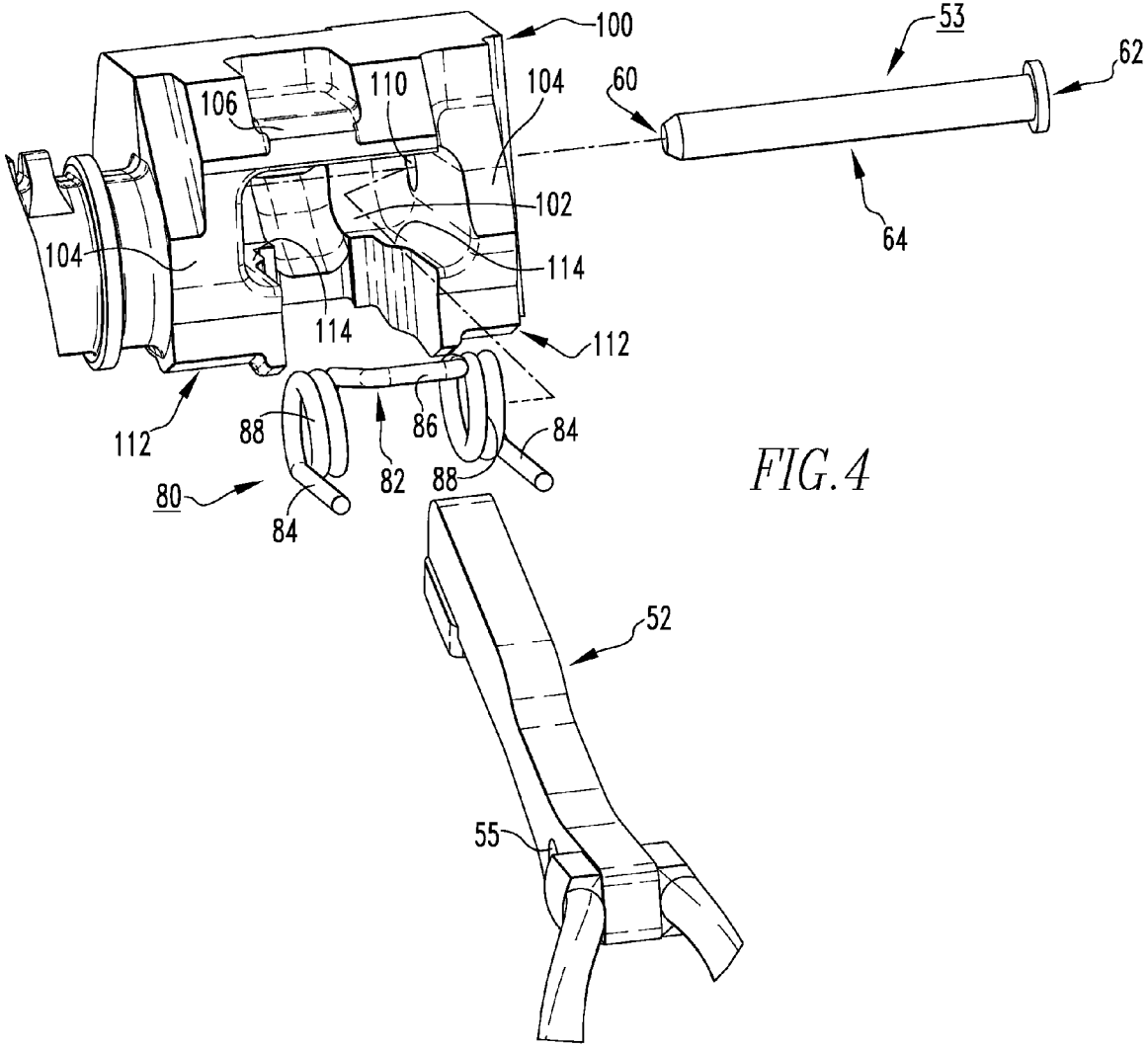
FIG. 4 is an exploded isometric view of a portion of the crossbar assembly of FIG. 3.
Figure 5:
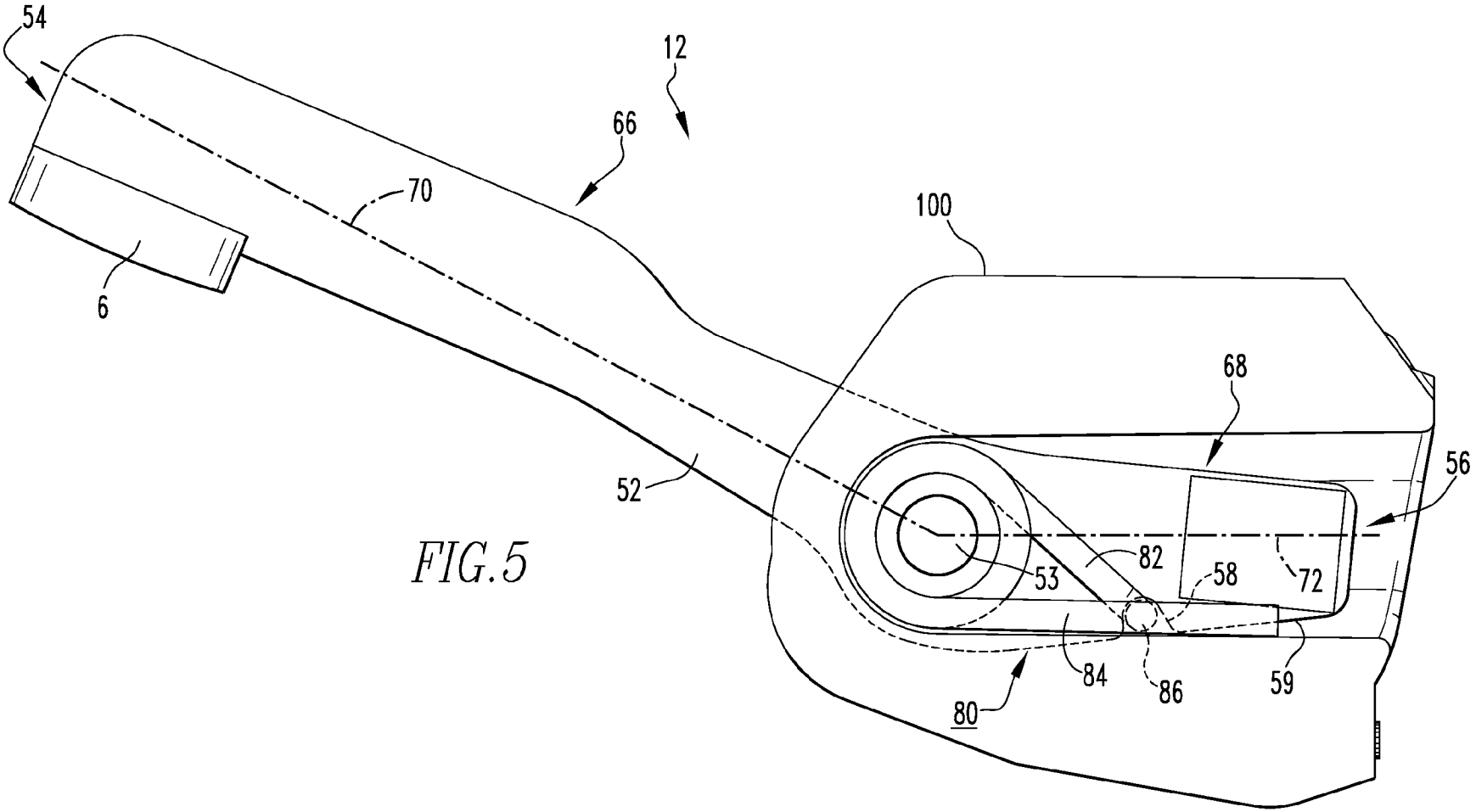
FIG. 5 is a vertical elevation view taken generally along lines 5-5 of FIG. 3 with a portion of one crossbar housing cut away to show internal structure.

A biasing member, such as torsion spring 80 shown in FIGS. 3-5, biases the second end 56 of the movable contact arm 52 in a counterclockwise direction about pivot pin 53 as indicated by arrow 57. This, in turn, biases the movable contact 6 disposed at or about the first end 54 of the movable contact arm 52 toward the stationary contact 8 (FIG. 1). In this manner, the operating mechanism 10 and crossbar 12 thereof, cooperate with the movable contact assembly 50 in order to pivot the movable contact arm 52 and associated movable contact 6 to thereby open (clockwise with respect to FIGS. 1, 2 and 5) and close (counterclockwise with respect to FIGS. 1, 2 and 5) the separable contacts 6, 8. In other words, the movable contact arm 52 pivots clockwise and counterclockwise (with respect to FIGS. 1, 2 and 5) as the separable contacts 6, 8 are brought into (as shown in FIG. 1) and out of (as shown in FIG. 2) electrical communication with one another. In the example of FIG. 1, the operating mechanism 10, crossbar 12 and movable contact assembly 50 are shown in the closed position, with the movable contact 6 and stationary contact 8 being in electrical communication.

Referring to FIGS. 3 and 4, the torsion spring 80 includes a U-shaped middle portion 82 and a pair of leg members 84 of generally linear shape disposed on opposite sides of the middle portion 82. The U-shaped middle portion 82 includes a lateral section 86 disposed generally perpendicular to the leg members 84. Additionally, the torsion spring 80 includes a pair of coils 88 between the U-shaped middle portion 82 and each of the leg members 84, with each of the coils 88 forming a lateral aperture 90 (FIG. 3) extending therethrough. As best shown in FIG. 4, leg members 84 are preferably oriented parallel with respect to each other. However, it is to be appreciated that the relative positioning of leg members 84 may be varied without departing from the scope of the invention.

As shown in FIG. 5, preferably the biasing of the second end 56 of the movable contact arm 52 by the torsion spring 80 is provided through engagement of the lateral section 86 of the torsion spring 80 with a notch 58 provided on the lower (with respect to FIG. 5) surface 59 of the movable contact arm 52. Preferably, the notch 58 is sized accordingly to fully accommodate the lateral section 86 of the torsion spring 80 such that the lateral section 86 does not extend below the lower surface 59 of the movable contact arm 52. It is to be appreciated that such a preferred arrangement allows for greater clearance below the movable contact arm 52, which thus allows for lower (with respect to FIG. 1) mounting of the arm 52 within a housing 100 of crossbar 12.

Referring again to FIGS. 3 and 4, each housing 100 of crossbar 12 includes a cavity 102 (FIG. 4) generally sized to accommodate a portion (not numbered) of the movable contact arm 52 along with the torsion spring 80 of the movable contact assembly 50. Cavity 102 is generally defined by a pair of opposing side walls 104, a top portion 106, and a front portion 108 (FIG. 3) of the housing 100. Each of side walls 104 includes an aperture 110 that is generally positioned and sized such to accommodate an end 60,62 of pivot pin 53. As shown in FIG. 4, the lower (with respect to FIG. 4) portions 112 of each of side walls 104 generally protrude inward forming a pair of ledges 114. Front portion 108 includes an open portion 109 preferably generally sized to closely accommodate a mid portion 74 (FIG. 3) of movable contact arm 52 as further detailed below.

Having thus described one of the housings 100 of the crossbar 12, a housing 100 having a movable contact assembly 50 installed therein will now be described. When movable contact arm 52 is installed within one of the housings 100, such as shown in the assembled portion of FIG. 3, the movable contact arm 52 is pivotally secured in place by pivot pin 53. More particularly, an intermediate portion 64 of pivot pin 53 is disposed in the aperture 55 of the movable contact arm 52 and the first end 60 and the second end 62 of the pivot pin 53 are each disposed in a corresponding one of apertures 110 of opposing side walls 104.

As previously mentioned, torsion spring 80 is generally positioned to bias movable contact arm 52 against housing 100 of the crossbar 12 in a counter clockwise direction (with respect to FIGS. 1, 2 and 5) about pivot pin 53. More particularly, torsion spring 80 is positioned such that each of coils 88 are disposed on either side of the movable contact arm 52 with the pivot pin 53 being disposed in the lateral apertures 90 formed by each of coils 88 and the lateral section 86 disposed in notch 58 of the movable contact arm 52, as previously discussed. Each of leg members 84 of torsion spring 80 is generally disposed along a corresponding one of ledges 114 of the opposing side walls 104 such that, preferably, each leg member 84 engages a corresponding one of ledges 114 generally along the entirety of the leg member 84. As shown in FIG. 5, such an arrangement of the movable contact arm 52 and torsion spring 80 within housing 100 provides for the second generally linear portion 68 of the movable contact arm 52 to be positioned generally parallel with respect to each of the leg members 84 of the torsion spring 80. Such positioning of the torsion spring 80 about, and in engagement with, the movable contact arm 52 allows for a relatively low profile and more compact crossbar assembly 12 in comparison to known designs. Such low profile and reduced height crossbar 12 allows greater moving arm 52 blow-off (in a circuit interruption) which is necessary for increased interruption ratings. Additionally, it is to be further appreciated that such positioning of the torsion spring 80 provides for reduced exposure of the torsion spring 80 to heat and debris produced during separation of the separable contacts 6,8. Such reduced exposure is provided both by positioning of the torsion spring 80 generally under the movable contact arm 52 as well as by the front portion 108 of the housing 100 that generally provides a barrier to such heat and debris by having the open portion 109 limited in size only to allow necessary movement of movable contact arm 52.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A movable arm assembly for an electrical switching apparatus, said electrical switching apparatus including an enclosure, a stationary contact, and an operating mechanism, said operating mechanism including a crossbar member having a number of housings, said movable arm assembly comprising:

an arm member having a first end, an opposite second end, a pivot point therebetween, and a portion extending generally from the pivot point to the opposite second end, said portion having a longitudinal axis, said arm member being structured to engage said crossbar member at or about said pivot point such that said arm member can pivot with respect to said crossbar member from a first position to a different second position;

a movable contact disposed at or about the first end of said arm member, said movable contact being structured to electrically contact said stationary contact when said arm member is at said first position;

a biasing member comprising a first portion and a second portion, said first portion and said second portion being of generally linear shape and oriented generally normal to each other, the first portion of said biasing member engaging said arm member at a point between the pivot point and the second end, and the second portion of said biasing member being structured to engage and bias against one of the number of housings of said crossbar member in a manner that biases said movable contact toward said stationary contact;

wherein the longitudinal axis of the portion of said arm member is oriented generally parallel to the second portion of said biasing member when said arm member is at said first position; and wherein the arm member further has a notch disposed between the pivot point and the second end, the notch being sized to fully accommodate the first portion of said biasing member such that the first portion does not extend below a lower surface of said arm member; and wherein the first portion of said biasing member is disposed within, and engages said notch.

2. A crossbar assembly for an operating mechanism of an electrical switching apparatus, said electrical switching apparatus including an enclosure and a number of stationary contacts, said crossbar assembly comprising:

a crossbar member having a number of housings;

a number of movable arm assemblies, each of said number of movable arm assemblies being disposed in a corresponding one of said number of housings of said crossbar member, each of said number of movable arm assemblies comprising:

an arm member having a first end, an opposite second end, a pivot point therebetween, and a portion extending generally from the pivot point to the opposite second, said portion having a longitudinal axis, said arm member being structured to engage said crossbar member at or about said pivot point such that said arm member can pivot with respect to said crossbar member from a first position to a different second position;

a movable contact disposed at or about the first end of said arm member, said movable contact being structured to electrically contact said stationary contact when said arm member is at said first position;

a biasing member comprising a first portion and a second portion, said first portion and said second portion being of generally linear shape and oriented generally normal to each other, the first portion of said biasing member engaging said arm member at a point between the pivot point and the second end, and the second portion of said biasing member being structured to engage and bias against one of the number of housings of said crossbar member in a manner that biases said movable contact toward said stationary contact;

wherein the longitudinal axis of the portion of said arm member is oriented generally parallel to the second portion of said biasing member when said arm member is at said first position; and wherein the arm member of each of said number of movable arm assemblies comprises a notch disposed between the pivot point and the second end, the notch being sized to fully accommodate the first portion of said biasing member such that the first portion does not extend below a lower surface of said arm member; and wherein the first portion of said biasing member is disposed within, and engages said notch.

3. An electrical switching apparatus comprising:

an enclosure;

a number of stationary contacts; and a crossbar assembly comprising:

a crossbar member having a number of housings; and a number of movable arm assemblies, each of said number of movable arm assemblies being disposed in a corresponding one of said number of housings of said crossbar member, each of said number of movable arm assemblies comprising:

an arm member having a first end, an opposite second end, a pivot point therebetween, and a portion extending generally from the pivot point to the opposite second end, said portion having a longitudinal axis, said arm member being structured to engage said crossbar member at or about said pivot point such that said arm member can pivot with respect to said crossbar member from a first position to a different second position;

a movable contact disposed at or about the first end of said arm member, said movable contact being structured to electrically contact said stationary contact when said arm member is at said first position;

a biasing member comprising a first portion and a second portion, said first portion and said second portion being of generally linear shape and oriented generally normal to each other, the first portion of said biasing member engaging said arm member at a point between the pivot point and the second end, and the second portion of said biasing member being structured to engage and bias against one of the number of housings of said crossbar member in a manner that biases said movable contact toward said stationary contact;

wherein the longitudinal axis of the portion of said arm member is oriented generally parallel to the second portion of said biasing member when said arm member is at said first position; and wherein the arm member of each of said number of movable arm assemblies comprises a notch disposed between the pivot point and the second end, the notch being sized to fully accommodate the first portion of said biasing member such that the first portion does not extend below a lower surface of said arm member; and wherein the first portion of said biasing member is disposed within, and engages said notch.

* * * * *